United States Patent [19]

Clark et al.

[11] Patent Number: 4,696,361

[45] Date of Patent: Sep. 29, 1987

[54] SWING-UP RADIATOR AND OIL COOLER ASSEMBLY

[75] Inventors: Brian C. Clark; Michael D. Jines, both of Owatonna, Minn.

[73] Assignee: Owatonna Manufacturing Company, Owatonna, Minn.

[21] Appl. No.: 858,072

[22] Filed: Apr. 22, 1986

Related U.S. Application Data

[63] Continuation of Ser. No. 592,720, Mar. 23, 1984, abandoned.

[51] Int. Cl.[4] ..... B60K 11/04

[52] U.S. Cl. ..... 180/68.4; 180/68.6; 180/68.1; 165/41; 165/86; 123/41.43

[58] Field of Search ..... 180/6.48, 68.1, 68.4, 180/68.6; 292/262, 338; 248/213.3; 220/213.3; 217/60 R, 60 B, 61; 165/86, 41; 123/41.33, 41.43

[56] References Cited

U.S. PATENT DOCUMENTS

| | | | |
|---|---|---|---|
| 656,633 | 8/1900 | Dutton | 292/262 X |
| 664,993 | 1/1901 | Chmelitzek | 292/262 X |
| 1,614,455 | 1/1927 | Cooke | 165/86 X |
| 2,040,947 | 5/1936 | Mojonnier et al. | 165/86 X |
| 2,100,490 | 11/1937 | Rippingille | 180/68.4 X |
| 2,250,795 | 7/1941 | Fitz Gerald . | |
| 3,297,080 | 3/1965 | Williams . | |
| 3,334,704 | 8/1967 | Gehrke et al. | 123/41.43 X |
| 3,786,891 | 1/1974 | Vogelaar et al. | 180/68.4 |
| 3,828,952 | 8/1974 | Klee . | |
| 3,834,478 | 8/1974 | Alexander . | |
| 3,938,586 | 2/1976 | Barlow et al. | 180/68.6 X |
| 4,018,270 | 4/1977 | Kolinger et al. | 180/68.6 X |
| 4,117,902 | 10/1978 | Henline et al. | 180/68.4 X |
| 4,287,961 | 9/1981 | Steiger | 180/68.4 |
| 4,454,926 | 6/1984 | Akins | 180/68.1 |

FOREIGN PATENT DOCUMENTS

| | | | |
|---|---|---|---|
| 224491 | 11/1962 | Austria | 292/262 |
| 509568 | 10/1955 | Fed. Rep. of Germany | 180/68.4 |
| 9706 | 10/1897 | Sweden | 165/86 |

*Primary Examiner*—Larry Jones

*Attorney, Agent, or Firm*—Merchant, Gould, Smith, Edell, Welter & Schmidt

[57] ABSTRACT

An improved cooling system for a skid steer loader includes a swing-up radiator and oil cooler assembly (60) incorporating a pair of radiators (64, 88) supported for independent pivotal movement between raised and lowered positions to facilitate access to the radiators, as well as access to the engine and associated components for service, maintenance and the like. The lowermost radiator (64) serves as the hydraulic oil cooler, and is supported in a frame (62) pivotal about a generally longitudinal axis (78). The uppermost radiator (88) serves as the engine cooler and is mounted in another shelf (86) pivotal about a second longitudinal axis (104). A latch assembly (106, 108, 110, 112 and 114) is provided for releasably securing the entire radiator and oil cooler assembly (60) in a lowered position and at least the upper radiator (88) in a raised position.

12 Claims, 7 Drawing Figures

Fig.3
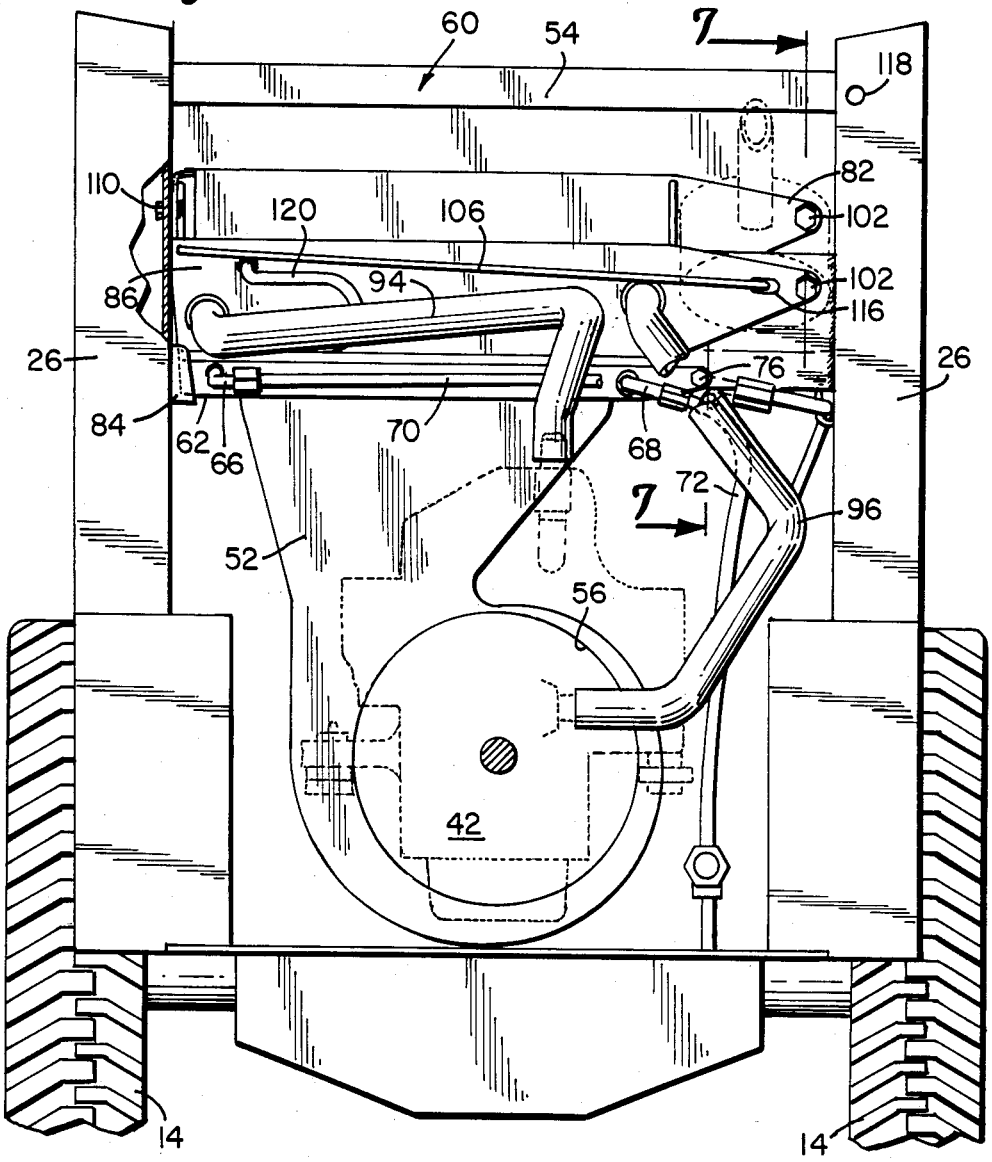
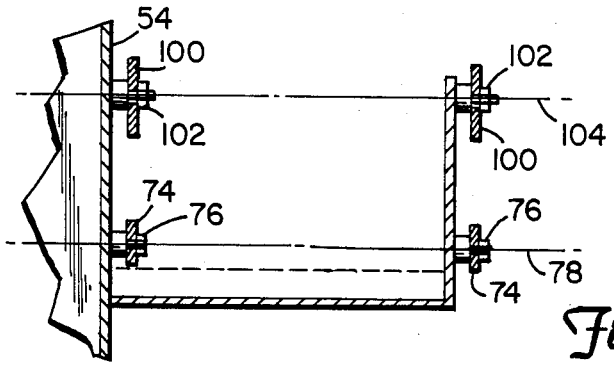
Fig.7

110
86
94
62
120
122
60
106
26
118
66
54
100
26
70
102
84
58
76
74
76
80
68
96
52
72
42
14
14

Fig.5
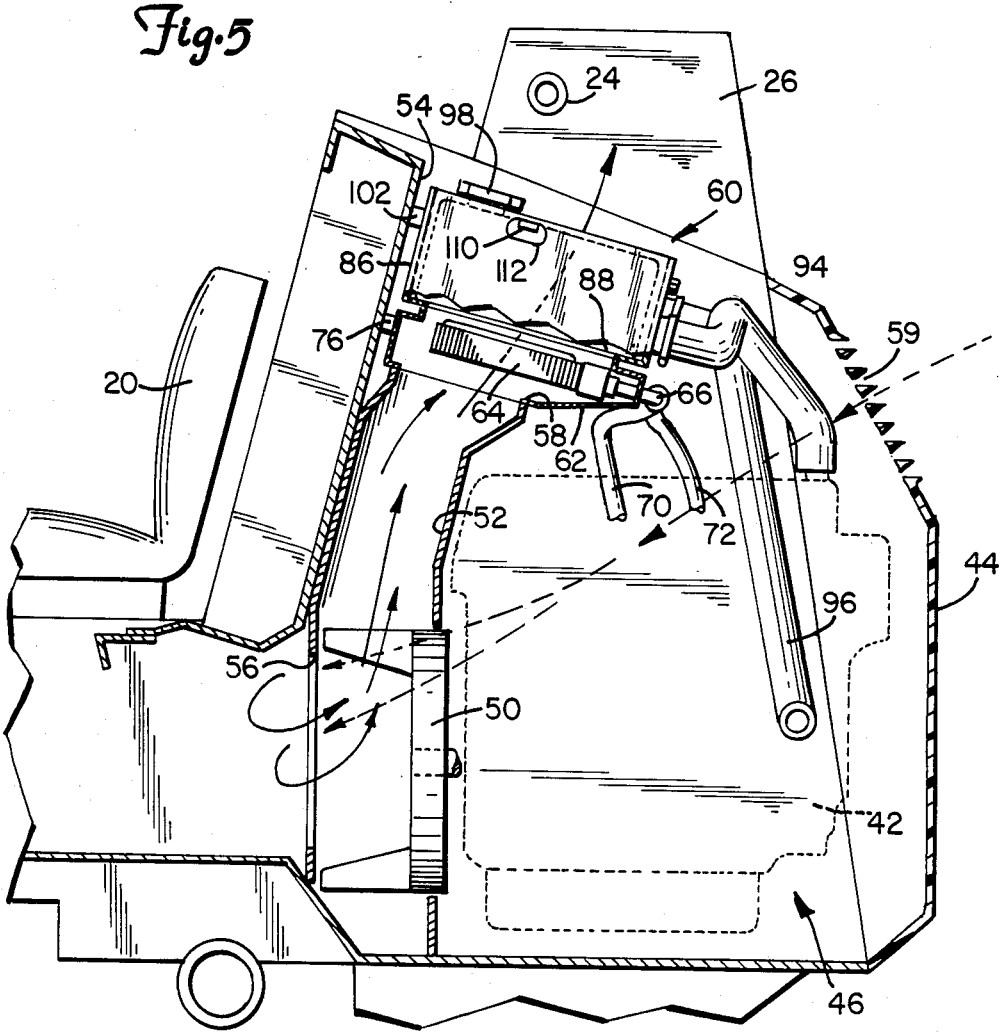
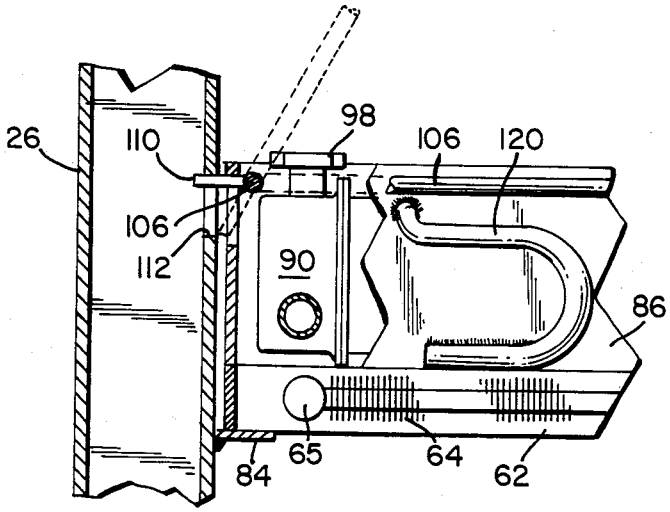
Fig.6

SWING-UP RADIATOR AND OIL COOLER ASSEMBLY

This is a continuation of application Ser. No. 592,720, filed Mar. 23, 1984, abandoned.

TECHNICAL FIELD

The present invention relates generally to a cooling system incorporating a swing-up radiator and oil cooler assembly. More particularly, this invention concerns an improved cooling assembly for a skid steer loader including two air/liquid heat exchangers, one for the engine coolant and the other for the hydraulic fluid, mounted for separate pivotal positioning over the engine to facilitate cleaning, maintenance and the like.

BACKGROUND OF THE INVENTION

A skid steer loader is a compact, highly maneuverable vehicle in which the wheels on opposite sides are independently driven. Maneuvering is accomplished by driving the wheels on opposite sides of the vehicle at different speeds and/or in different directions, usually by means of hydrostatic transmissions, to effect propulsion and steering. The operator sits in front of the engine and between a pair of hydraulically actuated loader arms on which a bucket, grapple fork, auger or other accessory can be carried. Suitable controls are provided in the operators compartment for controlling the vehicle and the loader arms, as well as any power accessory mounted on the loader. For effective skid steering, such vehicles must have relatively short wheel bases and treads, and maneuverability is further enhanced by the proper weight ratio between the front and rear axles under loaded and unloaded conditions. Skid steer loaders must therefore be designed for compactness and the desired front/rear axle weight ratio in order to facilitate skid steering as well as handling of loads.

It is desirable to distribute the weight between the axles of skid steer loaders so that the majority of weight is carried by the rear axle when the loader is empty or unloaded, and so that proper balance is maintained when the vehicle is loaded. This in turn means that the engine and related accessories, which comprise a significant amount of the weight, are mounted behind and relatively close to the rear axle. In addition, it is desirable to locate such components as low as possible to lower the center of gravity and thus enhance vehicle stability. Some skid steer loaders incorporate air-cooled engines, however, most utilize liquid-cooled engines whose cooling systems also enter into these design factors.

In the past, a popular approach to the design of cooling systems for skid steer loaders has been to stack the cooling system in longitudinally aligned relationship behind the engine. That is, the fan, radiator and oil cooler are aligned in "stacked" relationship behind the engine. This arrangement, however, is relatively bulky, thus detracting from the overall compactness of the vehicle, and it has also interferred with accessibility to the engine for service, maintenance and the like.

Cooling systems of more compact design have been developed heretofore for skid steer loaders, however, these prior approaches have not been without drawbacks. For example, the Hydra-Mac skid steer loaders include radiators mounted on doors on the rear body. U.S. Pat. No. 3,828,952 shows a skid steer loader wherein the radiator is located above the engine with a pair of fans being provided between the radiator and a grill in the rear body. More recently, U.S. Pat. No. 4,117,902 shows a cooling system for a skid steer loader wherein air is drawn through a rear grill by a fan located ahead of the engine and then blown out through an oil cooler and radiator overlying the engine compartment. While both of these latter two arrangements provide more longitudinal compactness over the axial cooling stacks of the prior art, neither arrangement is adapted to facilitate convenient access to the engine and related accessories for service and the like, or to facilitate cleaning of either the engine radiator and/or the oil cooler. It will be appreciated that skid steer loaders typically operate under adverse conditions which in turn often means higher service and maintenance requirements. The cooling systems of the prior art severely limit access to the engine and related accessories, and require at least partial disassembly for such access and/or cleaning of the radiator or oil cooler, which in turn is time consuming and expensive.

A need has thus arisen for an improved cooling system for a skid steer loader which avoids the drawbacks associated with axially stacked arrangements while affording the advantage of compactness together with better accessibility to the engine, oil cooler and radiator without requiring any disassembly whatever.

SUMMARY OF THE INVENTION

The present invention comprises a swing-up radiator and oil cooler assembly for a skid steer loader which overcomes the foregoing and other difficulties associated with the prior art. In accordance with the invention, which comprises an improvement over the system shown in U.S. Pat. No. 4,117,902, there is provided a cooling assembly which is particularly adapted for use with a skid steer loader. The cooling assembly herein includes a pair of air to liquid heat exchangers, one of which is a radiator for cooling hydraulic fluid and the other of which is a radiator for cooling engine coolant, arranged in superposed relationship above and slightly forward of the engine. The heat exchangers are supported on shelves which are independently pivoted to the inside of one of the uprights about generally longitudinal axes between raised and lowered positions. The lower shelf, which preferably contains the oil cooler, is supported at its free end in the lowered position by a bracket on the inside of the opposite upright. The upper shelf, which preferably contains the engine radiator, rests on top of the lower shelf in the lowered position and includes a latch by which it can be positively latched down in the lowered position. The handle of the latch is also adapted to hold the upper shelf, or both shelves if releasably connected, in the raised position. The shelves are independently pivotal to facilitate cleaning of both sides of either of the radiators therein, as well as access to the engine and associated accessories, including the underlying fan and shroud.

BRIEF DECRIPTION OF THE DRAWINGS

A better understanding of the invention can be had by reference to the following Detailed Description in conjunction with the accompanying Drawings wherein:

FIGS. 3 and 4 are enlarged rear elevational views of the engine compartment showing the swing-up radiator and oil cooler assembly of the invention in the lowered and raised positions, respectively;

Figure 2:
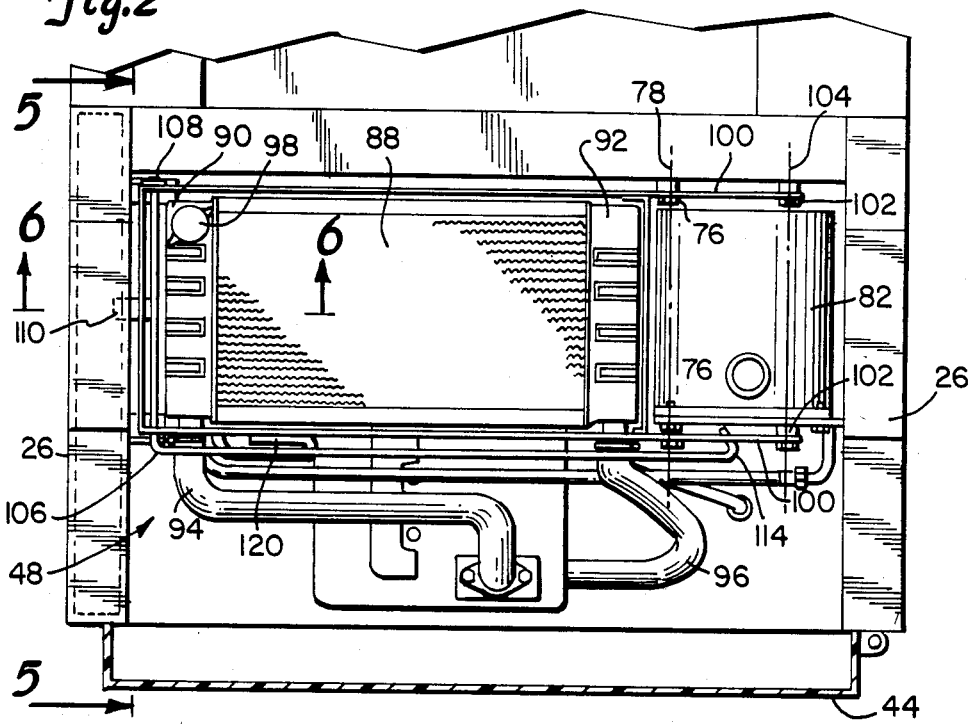
FIG. 2 is enlarged top plan view of the engine compartment, with the top grill being removed for clarity.

FIGS. 5 and 6 are sectional views taken generally along lines 5—5 and 6—6, respectively, of FIG. 2 in the direction of the arrows; and FIG. 7 is a sectional view taken generally along lines 7—7 of FIG. 3 in the direction of the arrows.

DETAILED DECRIPTION

Figure 1:
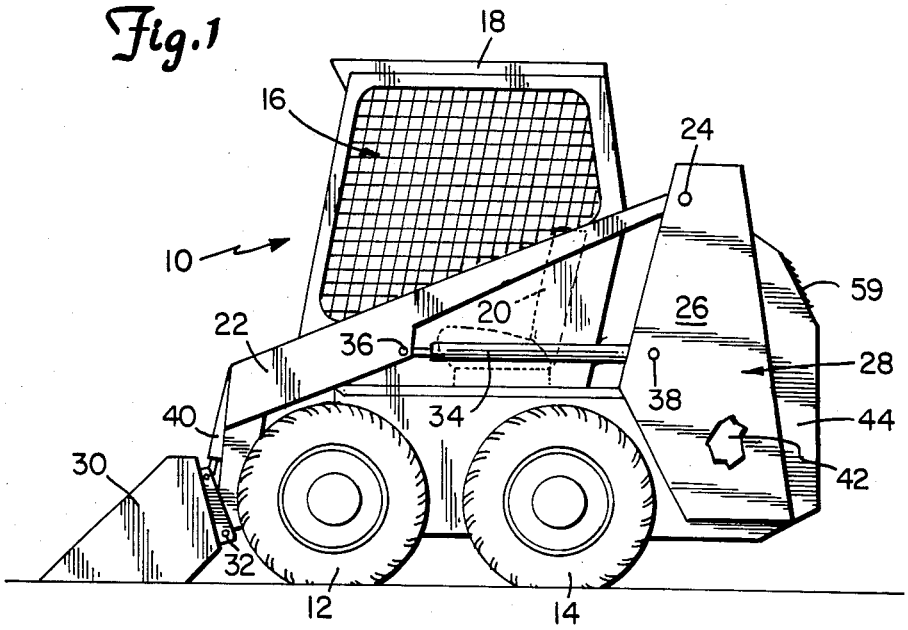
FIG. 1 is a side view of a skid steer loader incorporating the improved cooling system incorporating the swing-up radiator and oil cooler assembly of the invention.

Referring now to the Drawings, wherein like reference numerals designate like or corresponding elements throughout the views, and particularly referring to FIG. 1, there is shown a skid steer loader 10 with the improved cooling system incorporating the invention. The skid steer loader 10 includes a pair of front wheels 12 and a pair of rear wheels 14, only one each of which is shown, mounted on a relatively short wheel base and narrow tread to facilitate skid steering. An operators compartment 16 including a roll cage 18 and seat 20, is located between a pair of lift arms 22. The inner ends of the lift arms are connected at pivot points 24 to uprights 26 at the rear of the vehicle frame 28. An implement 30 such as a bucket, is connected at pivot points 32, only one of which is shown, to the outer ends of the lift arms 22. Raising and lowering of the lift arms 22 is effected by a pair of double acting cylinders 34, one of which is coupled between a pivot point 36 on each lift arm and a pivot point 38 on the associated upright 26. Tilting of the bucket 30 is effected by a single double-acting cylinder 40 coupled between the bucket and a cross member (not shown) extending between the lift arms.

The operators compartment 16 includes suitable controls for controlling the skid steer loader 10, lift arms 22 and bucket 30. An engine 42 is located in an engine compartment behind the operators compartment 16 and between uprights 26. A rear door 44 is provided for access to the engine 42 and associated components. As will be explained more fully hereinafter, the skid steer loader 10 incorporates a cooling system featuring a swing-up radiator and oil cooler assembly which is adapted to facilitate better access for service, maintenance, cleaning and the like.

Referring now to FIGS. 2 and 5, the engine compartment 46 of the skid steer loader 10 includes the engine 42, cooling system 48, and associated components. The engine 42, which has been shown in phantom lines for clarity, is a liquid cooled, internal combustion engine of either the gas fired or diesel type. The rear mounted engine 42 drives a conventional tandem pump assembly (not shown) which includes variable displacement pumps connected to the hydraulic drive motors of the respective hydrostatic transmissions for independently driving each set of wheels 12 and 14.

The cooling system 48 of the loader 10 includes a fan 50 which is driven by the engine 42. The fan 50 is located inside a shroud 52 which extends upwardly between the engine 42 and a fire wall or cross member 54 extending between the uprights 26. A fuel tank (not shown) is disposed in the recess between the back of seat 20 and the cross member 54. The shroud 52 includes an inlet 56 and outlet 58. Ambient air is drawn through louvers 59 in door 44, carried over the engine 42 and into the inlet 56 from beneath the seat 20 by fan 50 and forced upwardly through the shroud 52 by fan 50 and out of the outlet 58 past a swing-up radiator and oil cooler assembly 60 incorporating the invention. As will be explained more fully hereinafter, the swing-up radiator and oil cooler assembly 60 allows for independently pivotal movement of two radiators to facilitate service, maintenance and cleaning without disconnection or removal of any components.

With reference now to FIGS. 2–7, the swing-up radiator and oil cooler assembly 60 of the invention is located in overlying relationship, above and generally ahead of the engine 42. The assembly 60 includes a lower shelf 62 of generally rectangular frame construction for supporting an oil cooler 64 therein. The periphery of shelf 62 is of generally L-shaped cross section for supporting the oil cooler 64 therein while allowing flow of air through the oil cooler. The oil cooler 64 comprises a substantially conventional air/liquid heat exchanger for cooling the hydraulic fluid utilized by the skid steer loader 10 for driving wheels 12 and 14 and for actuating arms 22. The oil cooler 64 is of conventional construction, including a pair of headers 65 at opposite sides, one of which is best seen in FIG. 6, to which fittings 66 and 68 are connected. Hoses 70 and 72 are connected respectively to fittings 66 and 68 for circulating hydraulic fluid through the oil cooler 64, which is located directly over the outlet 58 of the fan shroud 52 when the lower shelf 62 is in the lowered position.

Figure 4:
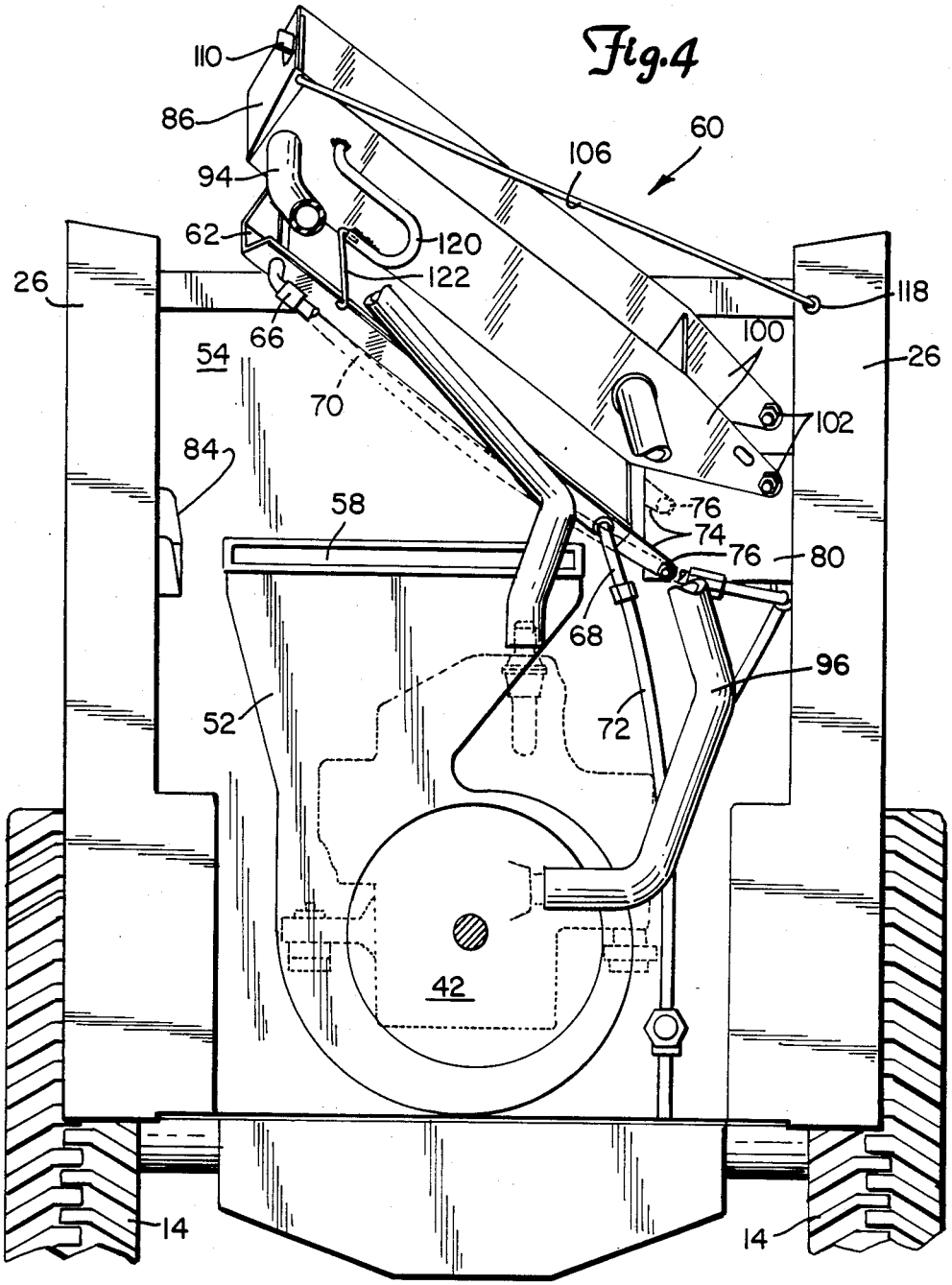

The lower shelf 62 is pivotal between lowered and raised positions as illustrated in FIGS. 3 and 4. In particular, a pair of lateral legs or extensions 74 are provided on one side of the shelf 62 for connection to pivots 76 for pivotal movement about a generally longitudinal axis 78. As illustrated, one extension 74 and associated pivot 76 are located on the cross member 54, while the other extension and associated pivot are located on a bracket 80 which is adapted for supporting the muffler 82. The bracket 80 is secured to the inside of one upright 26 and adjacent portion of the rear side of the cross member 54. A bracket 84 is provided on the inside of the opposite upright 26 for supporting the free end of the lower shelf 62 in the lowered position.

The swing-up radiator and oil cooler assembly 60 also includes an upper shelf 86 for supporting a second air/-liquid heat exchanger 88. The upper shelf is also of generally rectangular frame construction, with an L-shaped periphery, to support the radiator 88 while allowing flow of air through it. In particular, the second heat exchanger 88 is for the purpose of cooling liquid coolant circulating through the engine 42. The heat exchanger 88 is of conventional construction including the pair of headers 90 and 92 provided at opposite ends with fittings therein to which hoses 94 and 96 are connected, respectively. A removable cap 98 is provided on the header 90 for replenishing coolant. Similarly to the lower shelf 62, the upper shelf 86 includes a pair of legs or extensions 100 which are connected by pivots 102 for pivotal movement about a generally longitudinal axis 104. One extension 100 and the associated pivot are located on the cross member 54 while the other extension and associated pivot are located on the bracket 80. It will therefore be apparent that the shelves 62 and 86 are superposed and independently pivotal about separate generally longitudinal axes 78 and 104 which are both vertically and laterally offset from each other.

A latch mechanism is provided on the upper shelf 86 primarily for releasably securing the upper shelf in a lowered position down against the lower shelf 62, and for holding the upper shelf in a raised position. The latch mechanism includes a generally L-shaped rod 106 having a longitudinal portion which extends through openings in the free end of the upper shelf 86 and is secured by a washer and cotter key 108. A tab 110 is secured to the longitudinal portion of the rod 106 for cooperation with a slot 112, as is best seen in FIG. 6, located in the inside surface of the adjacent upright 26. The relatively longer lateral portion of the rod 106 terminates in a hook 114, as is best seen in FIG. 2, which is adapted for cooperation either with a slot 116 in the rear most extension 100 of the upper shelf 86, or an opening 118 in the adjacent upright 26.

When the end 114 of the rod 106 is positioned in opening 116, the tab 110 is engaged with the notch 112 and the radiator and oil cooler assembly 60 is secured in a lowered position immediately over the outlet 58 of the fan shroud 52 so that air can be blown across the oil cooler 64 and then the radiator 88 before exiting upwardly toward a grill (not shown) out of the engine compartment 46. When it is desired to raise the upper shelf 86, the lateral portion of the rod 106 is flexed outwardly to disengage the end 114 from opening 116 so that it can be raised, disengaging the tab 110 such that the upper shelf 86 can be lifted to a raised position as shown in FIG. 4. The end 114 of the rod 106 can then be engaged with opening 118 on the upright 26 to hold the upper shelf in a raised position. A handle 120 is preferably provided on the upper shelf 86 for facilitating lifting.

It will thus be appreciated that the radiator and oil cooler assembly 60 includes two separate air/liquid heat exchangers or radiators 64 and 88 overlying the engine compartment 46 which are independently supported for pivotal movement about pivotal axes 78 and 104. The radiators 64 and 88 are supported in generally rectangular frames or shelves 62 and 86 and are positioned in superposed relationship in the normal lowered position, in which the lower shelf rests on bracket 84 and the upper shelf rests on top of it, secured in place by latch 110. The upper radiator 88 can be releasably secured in the raised position by means of rod 106 and opening 118. When the upper radiator 88 is so located in the raised position, the lower radiator 64 can also be lifted and releasably secured in raised position, if desired, by means of a hook 122 engageable with the handle 120 or other suitable portion of the upper shelf 86. As illustrated, the hook 122 is pivotally secured to the lower shelf 62 for movement into or out of engagement with the handle 120 on the upper shelf 86.

From the foregoing, it will thus be apparent that the present invention comprises an improved cooling system which features a unique swing-up radiator and oil cooler assembly having several advantages over the prior art. The invention herein is particularly adapted for use with construction vehicles such as skid steer loaders, whose engine compartments are subject to compact design constraints particular to such vehicles. The invention includes two separate radiators which are independently pivotal between raised and lowered positions to facilitate access to either side of each radiator, or both radiators, as well as access to the engine and other associated components for service, maintenance, cleaning and the like. The swing-up radiator and oil cooler assembly and connecting hoses are arranged so that no disassembly whatever is required. Other advantages will be evident to those skilled in the art.

Although certain embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. In combination with a skid steer loader including a frame defining a ventilated engine compartment with an engine located between a pair of laterally spaced-apart opposing uprights behind an operators compartment, a cooling system comprising:

a fan located between the engine and the operators compartment;

a shroud surrounding the fan and extending generally upward from an inlet to an outlet;

a laterally extending upper radiator disposed between the uprights, over the outlet of said fan shroud;

a laterally extending lower radiator mounted between the uprights and mounted between said upper radiator and the outlet of said fan shroud;

means for supporting said upper radiator for pivotal movement between raised and lowered positions relative to said lower radiator;

means secured to at least one upright for supporting said upper radiator in the lowered position adjacent said lower radiator;

means for releasably securing said upper radiator in the lowered position; and means for releasably supporting said upper radiator in the raised position.

2. A cooling system for a hydrostatically driven skid steer loader having a ventilated engine compartment containing an engine located between a pair of laterally spaced-apart opposing uprights and behind an operators compartment, comprising:

a fan located between said engine and the operators compartment;

a shroud surrounding said fan and extending generally upwardly from an inlet to an outlet;

upper and lower superposed radiators extending between the uprights and over the outlet of said fan shroud;

means connected to one upright for pivotally supporting said upper radiator for movement about a generally longitudinal axis between raised and lowered positions;

means connected to said one upright for pivotally supporting said lower radiator for pivotal movement about a generally longitudinal axis between raised and lowered positions;

a bracket secured to the opposite upright for supporting said lower radiator in the lowered position, with said upper radiator resting on said lower radiator in the lowered position; and means for releasably securing at least said upper radiator in either the lowered position or the raised position.

3. The cooling system of claim 2, wherein said means for pivotally supporting said upper radiator comprises:

a generally rectangular frame having opposite ends;

a pair of lateral extensions secured in longitudinally spaced apart relationship to one end of said frame; and means for connecting said extensions to said one upright for pivotal movement.

4. The cooling system of claim 2, wherein said means for pivotally supporting said lower radiator comprises:

a generally rectangular frame having opposite ends;

a pair of lateral extensions secured in longitudinally spaced apart relationship to one end of said frame;

means for connecting said extensions to said one upright for pivotal movement; and a bracket connected to said opposite upright for supporting said frame in the lowered position.

5. A cooling system for a hydrostatically driven skid steer loader having a ventilated engine compartment containing an engine located between a pair of laterally spaced-apart opposing uprights and behind an operators compartment, comprising:

a fan located between said engine and the operators compartment;

a shroud surrounding said fan and extending generally upwardly from an inlet to an outlet;

upper and lower superposed radiators extending between the uprights and over the outlet of said fan shroud;

means connected to one upright for pivotally supporting said upper radiator for movement between raised and lowered positions;

means connected to said one upright for pivotally supporting said lower radiator for pivotal movement between raised and lowered positions;

a bracket secured to the opposite upright for supporting said lower radiator in the lowered position, with said upper radiator resting on said lower radiator in the lowered position; and means for releasably securing at least said upper radiator in at least the lowered position, including:

a latch mounted on said pivotal support means for said upper radiator, said latch being selectively engageable with a notch formed in one of the uprights; and an actuating rod connected to said latch, said rod having a turned end engageable between a stowed position in an opening in said pivotal support means for said upper radiator, and in an extended position in an opening in one of said uprights for holding said upper radiator in a raised position.

6. A cooling system for a hydrostatically driven skid steer loader having a ventilated engine compartment containing an engine located between a pair of laterally spacedapart opposing uprights and behind an operators compartment, comprising:

a fan located between said engine and the operators compartment;

a shroud surrounding said fan and extending generally upwardly from an inlet to an outlet;

upper and lower superposed radiators extending between the uprights and over the outlet of said fan shroud;

means connected to one upright for pivotally supporting said upper radiator for movement between raised and lowered positions;

means connected to said one upright for pivotally supporting said lower radiator for pivotal movement between raised and lowered positions;

a bracket secured to the opposite upright for supporting said lower radiator in the lowered position, with said upper radiator resting on said lower radiator in the lowered position; and means for releasably securing at least said upper radiator in at least the lowered position, including:

a latch mounted on said pivotal support means for said upper radiator, said latch being selectively engageable with a notch formed in one of the uprights;

an actuating rod connected to said latch, said rod having a turned end engageable between a stowed position in an opening in said pivotal support means for said upper radiator, and in an extended position in an opening in one of said uprights for holding said upper radiator, and in an extended position in an opening in one of said uprights for holding said upper radiator in a raised position; and hook means for selectively interconnecting said upper and lower pivotal support means when in their raised positions.

7. The cooling system of claim 2, further including:

a pair of first hoses connected to said upper radiator for circulating engine coolant therethrough; and a pair of second hoses connected to said lower radiator for circulating hydraulic fluid therethrough.

8. A swing-up radiator assembly for use in the engine compartment of a skid steer loader having a pair of laterally spaced-apart opposing uprights, comprising:

a laterally extending first shelf, said first shelf being of generally rectangular frame construction;

means for connecting one end of said first shelf to one upright for pivotal movement about a first generally longitudinal axis between raised and lowered positions;

a bracket secured to the opposite upright for supporting said first shelf in the lowered position;

a first fluid heat exchanger supported within said first shelf;

a pivotal latch mounted on said first shelf for movement into and out of engagement with a slot at one end formed in the opposite upright, when said first shelf is in the lowered position; and an actuating rod connected at one end to said latch for pivotal movement with said latch, said actuating rod having an opposite turned end engageable between a stowed position in an opening formed in said first shelf wherein said latch is engaged in the slot, thus securing said first shelf in the lowered position, and an upwardly pivoted position in an opening formed in said one upright wherein said latch is disengaged from the slot, thus securing said first shelf in the raised position.

9. The swing-up radiator assembly of claim 8, further including:

a second laterally-extending shelf of generally rectangular frame construction disposed between said first shelf and said bracket;

means for pivotally connecting one end of said second shelf to said one upright for pivotal movement about a second generally longitudinal axis between a raised position and a lowered position supported on said bracket;

a second fluid heat exchanger mounted on said second shelf; and hook means for releasably connecting said, second shelf to said first shelf when in their raised positions.

10. The swing-up radiator assembly of claim 8, further including:

a handle secured to said first shelf.

11. A swing-up radiator and oil cooler assembly for mounting between a pair of laterally spaced-apart opposing uprights in the engine compartment of a skid steer loader, which comprises:

upper and lower transverse shelves positioned in superposed relationship, each shelf being of generally rectangular frame construction;

means for pivotally connecting one end of said upper shelf to one upright for pivotal movement about a first generally longitudinal axis between raised and lowered positions;

means for pivotally connecting one end of said lower shelf to said one upright for pivotal movement about a second generally longitudinal axis between raised and lowered positions;

said first and second axes being laterally and longitudinally spaced apart;

an engine coolant radiator supported on said upper shelf;

an oil cooler supported on said lower shelf;

a bracket connected to the opposite upright for supporting said lower shelf in the lowered position;

a latch mounted on said upper shelf for movement into and out of engagement with a slot formed in said opposite upright, when said upper shelf is in the lowered position; and an actuating rod connected at one end to said latch for pivotal movement with said latch, said actuating rod having an opposite turned end engageable between a stowed position in an opening formed in said first shelf wherein said latch is engaged in the slot, thus securing said first shelf in the lowered position, and an upwardly pivoted position in an opening formed in said one upright wherein said latch is disengaged from the slot, thus securing said first shelf in the raised position.

12. The swing-up radiator and oil cooler assembly of claim 11, further including:

a handle mounted on said upper shelf; and hook means for releasably interconnecting said upper and lower shelves when in their raised positions.

* * * * *